United States Patent [19]

Uhrig

[11] Patent Number: 4,693,161

[45] Date of Patent: Sep. 15, 1987

[54] APPARATUS FOR SUPPORTING A MUSICAL INSTRUMENT

[76] Inventor: Ira J. Uhrig, 4015 Northwest Ave., Bellingham, Wash. 98226

[21] Appl. No.: 852,536

[22] Filed: Apr. 14, 1986

[51] Int. Cl.[4] ..... G10G 5/00

[52] U.S. Cl. ..... 84/327; 84/291

[58] Field of Search ..... 84/327, 291, 453

[56] References Cited

U.S. PATENT DOCUMENTS 1,673,205 6/1928 Romao ..... 84/327

4,592,265 6/1986 Steinberger ..... 84/327

OTHER PUBLICATIONS

Wheeler, "American Guitars", Harper & Row, New York, 1982, pp. 222, 225.

*Primary Examiner*—Lawrence R. Franklin

*Attorney, Agent, or Firm*—Hughes & Cassidy

[57] ABSTRACT

A stand for supporting a musical instrument, such as a guitar, in an upright position when the musical instrument is not in use. The stand includes a mounting bracket which is rigidly connected to an upper portion of the instrument, and a downwardly depending support member which is pivotally connected to the mounting bracket to permit movement of the support member between a first stowed position adjacent to the instrument, and a second operable position spaced away from the instrument. When the stand is in the operable position, the instrument is supported on a bottom edge of the instrument in cooperation with the lower end of the support member.

15 Claims, 13 Drawing Figures

APPARATUS FOR SUPPORTING A MUSICAL INSTRUMENT

TECHNICAL FIELD

The present invention relates to apparatus for supporting a musical instrument when it is not being played, and more particularly to an apparatus which is pivotally connected to a musical instrument, such as a guitar, and which together with a bottom edge of the musical instrument supports the instrument in an upright position.

BACKGROUND OF THE INVENTION

A common problem encountered by musicians is the temporary placement of their instrument when it is not being played during those times when it is inconvenient to replace the instrument in its case. This situation typically arises when the musician desires to take a short break from playing, or when the musician intends to play several instruments during a performance and needs quick and easy access to these various instruments.

Various conventional stands for supporting musical instruments in an upright position when they are not being used have been disclosed, such as for example, in U.S. Pat. No. 1,060,581 by Buegeleisen; U.S. Pat. No. 1,612,148 by Oettinger; U.S. Pat. No. 1,684,912 by Dunklau; U.S. Pat. No. 3,958,786 by Mann; and U.S. Pat. No. 2,464,031 by Fiedel. These patents pertain to apparatus for supporting musical instruments in a generally upright position above a supporting surface. Each apparatus includes a frame having a lower member extending upward from the supporting surface for engaging a bottom portion of the instrument, and an upper member for engaging an upper portion of the musical instrument to support the instrument in a generally upright position.

Apparatus for storing a plurality of musical instruments in a generally upright position have been disclosed in U.S. Pat. No. 2,058,184 by Sherrard; and U.S. Pat. No. 4,036,462 by Sheftel. The Sherrard patent discloses an apparatus having horizontally extending upper and lower members for supporting respective upper and lower portions of the musical instrument. On the other hand, the Sheftel patent discloses a lower frame having a plurality of upstanding members of different configurations for supporting various types of musical instruments thereon.

Other apparatus for supporting musical instruments in an upright position include Wenger, U.S. Pat. No. 2,934,131, which discloses a chair having a member extending upward from a back of the chair to support an upper portion of the instrument, and a lower member extending horizontally from a leg of the chair to engage a bottom portion of the musical instrument.

A support stand having a collapsible tripod-like lower base portion and an upper portion having a pair of outwardly extending forks for engaging an upper portion of the musical instrument to support it in an erect position is shown in U.S. Pat. No. 1,045,583 by Mills.

A housing protector for the base of a guitar, disclosed in U.S. Pat. No. 3,251,258 by Parker, includes a lower portion with a pair of downwardly projecting legs and an upper portion to which a downwardly depending elongated leg is pivotally connected to form a tripod base for supporting the guitar in an upright manner.

Conventional support stands for musical instruments have a number of deficiencies which make their use both cumbersome and inefficient. For example, these stands must be transported separately from the musical instrument, and thus they add to the amount of equipment which the musician typically must carry. Furthermore, these stands occupy a significant amount of space which is essentially wasted when the stands are not being used to support the instrument. Often these stands are used during a musical performance in a stage environment where space is rather limited, and constitute additional obstacles about which the musicians must maneuver during a performance. In addition, the conventional support stands have a relatively high center of gravity since they are typically configured to support the instrument in an erect position by engaging an upstanding neck portion of the instrument. This high center of gravity makes them stand less stable and more susceptible to falling over.

SUMMARY OF THE INVENTION

The present invention pertains to a stand for supporting a musical instrument, such as a guitar, in an upright position when the instrument is not being used by a musician. The stand remains attached to the instrument when it is being played. The stand includes an elongated support which extends downwardly from an upper portion of the instrument to engage a supporting surface, such as a floor or tabletop. The bottom of the elongated support includes a foot portion which together with a bottom portion of the musical instrument defines a plane for supporting the instrument in the upright position.

The elongated support is pivotally connected to the instrument to permit it to be pivoted between a first stowed position where the foot portion is adjacent to the musical instrument, and a second operable position. spaced away from the musical instrument where the bottom of the instrument and the foot portion form a tripod-like support. In the stowed position, the elongated support is positioned so as not to interfere with the musician when the instrument is being played.

It is therefore an object of the present invention to provide a support stand which is attached to a musical instrument, such as a guitar, for supporting the instrument in an upright position when the instrument is not in use.

BRIEF DESCRIPTION OF THE DRAWINGS

These and other objects and advantages of the present invention will become more readily apparent upon reading the following Detailed Description and upon reference to the attached drawings in which.

Figure 2:
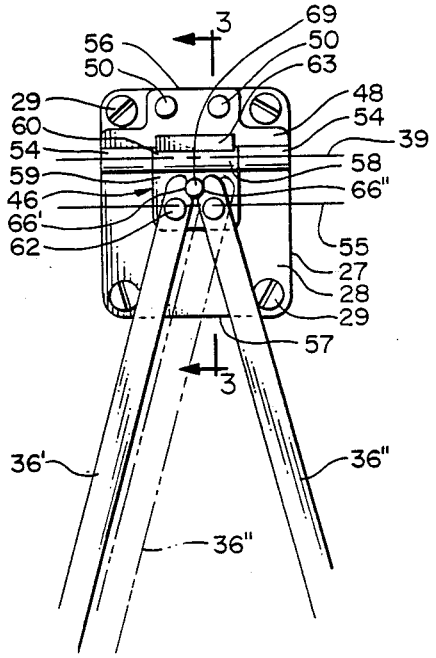
FIG. 2 is a plan view of an upper portion of the support stand including means for mounting the elongated support legs to the body of the guitar.

While the present invention is susceptible of various modifications and alternative forms, specific embodiments thereof have been shown by way of example in the drawings and will be described herein in detail. It should be understood, however, that it is not intended to limit the invention to the particular forms disclosed, but on the contrary, the intention is to cover all modifications, equivalents and alternatives falling within the spirit and scope of the invention.

DETAILED DESCRIPTION OF THE INVENTION

The present invention relates to a stand for supporting a hand-held musical instrument in an upright position on a substantially horizontal surface whereby the stand and the bottom portion of the musical instrument engage the supporting surface to cooperatively support the instrument in an upright position. Although the present invention will be described for use in supporting a guitar, it should be appreciated that the present invention may be utilized to support other musical instruments such as a bass violin, 'cello, banjo, saxophone or the like. In the present invention, the stand is attached to the instrument and remains attached to the instrument while it is being played.

Figure 1:
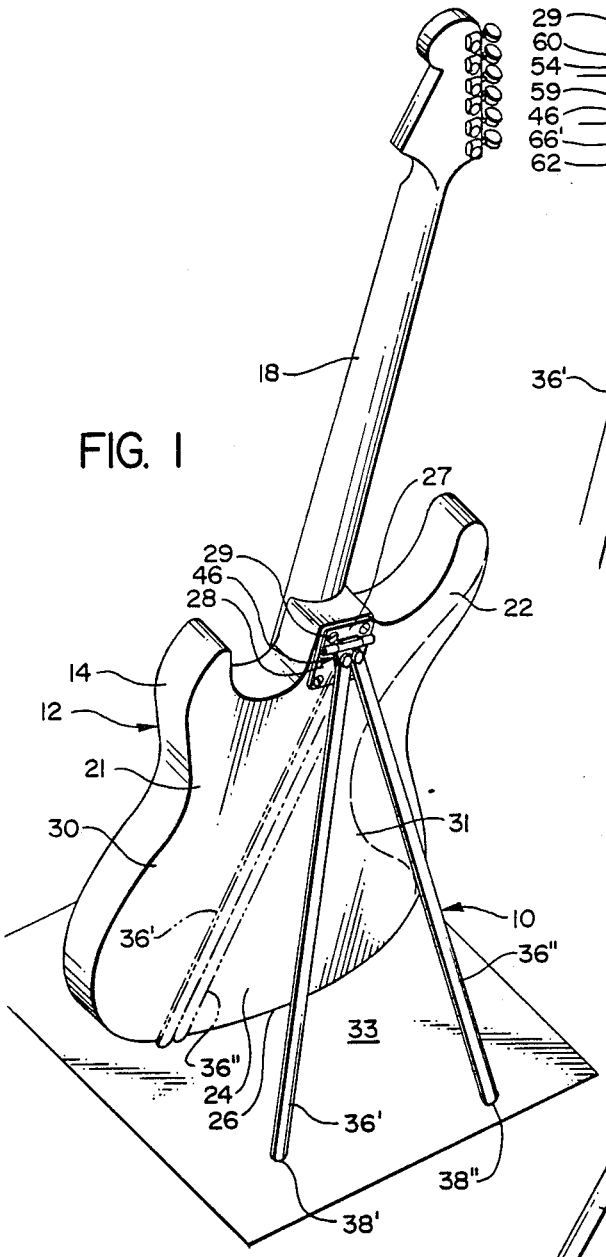
FIG. 1 is an isometric rear view of a guitar having attached thereto an exemplary embodiment of the support stand of the present invention which includes two elongated support legs extending downward from an upper portion of the body of the guitar.
Figure 5:
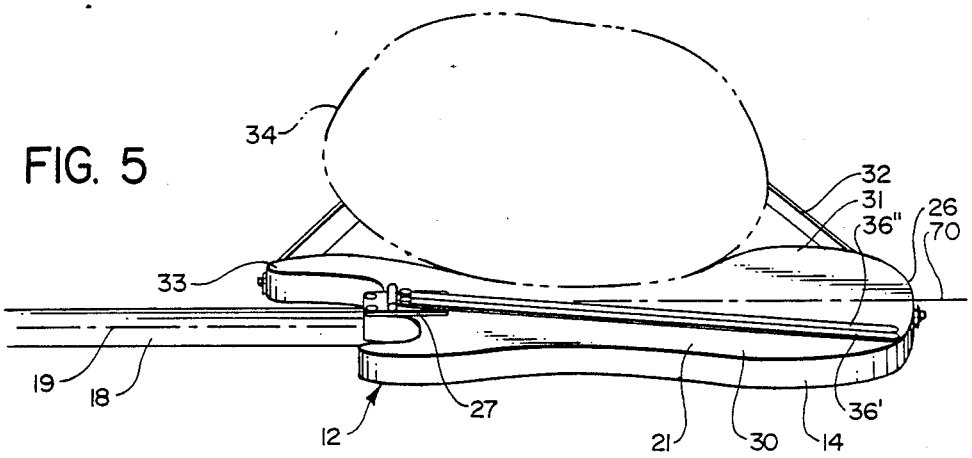
FIG. 5 is a view looking upward from beneath the guitar showing the manner in which the guitar is typically supported by a strap on the shoulders of a musician whose torso is shown in phantom.
Figure 4:
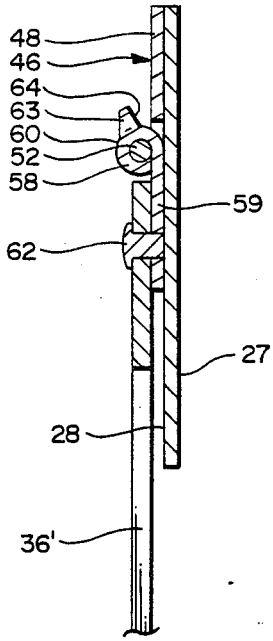
FIG. 4 is a side sectional view of the embodiment shown in FIGS. 1 through 3 showing the supporting legs in a stowed position adjacent to the rear surface of the guitar.

In an exemplary embodiment shown in FIG. 1, a support stand, generally indicated at 10, is adapted for supporting a conventional electric guitar indicated at 12, in a generally upright position. Guitar 12 includes a body 14, a neck 18 which is rigidly connected to the body 14, and which has a lengthwise axis represented by a line 19 in FIG. 5. The body 14 includes a front portion (not shown) where strings (also not shown) are attached thereto and extend between the body and a guitar head which is rigidly connected to the neck 18. The guitar body 14 is further defined by a rear surface 21 including an upper portion 22, and a lower portion 24 which terminates at a bottom edge 26. In many electric guitars, in order to connect neck 18 to body 14, a conventional mounting bracket is utilized. This conventional bracket includes mounting screws which extend through the bracket, the guitar body and into the guitar neck. In the present invention, a support stand is mounted to the guitar in the same manner as the conventional mounting bracket so as to minimize any adverse changes to the cosmetic features of the guitar. A mounting bracket 27 having an outer surface 28 is attached to guitar upper portion 22 by screws 29 which extend through the body 14 and connect neck 18. Rear surface 21 of guitar body 14 also includes a left portion 30 and a right portion 31. When the guitar is held in a playing position by the musician as shown in FIG. 5, guitar 12 is typically supported by a conventional strap 32 which extends between lower edge 26 of the guitar body and a forward edge 33. It should be appreciated that the terms "top", "bottom", "left" and "right" used to describe the locations of guitar components, refer to the guitar when it is in its upstanding position as shown in FIG. 1. However, when the guitar is supported by strap 32 across the shoulders of a right handed musician as shown in FIG. 5, the guitar occupies a position where the neck 18 is somewhat parallel to a supporting surface 33, and right portion 31 of rear surface 21 is located above left portion 30 of rear surface 21. In this position, the guitar is conventionally supported from the guitar strap so that the left (now lower) portion 30 of rear surface 21 is displaced outwardly from the trunk 34 of the musician shown in cross section by phantom lines in FIG. 5. Consequently the right (now upper) portion 31 of the guitar rear surface 21 is displaced inwardly against the trunk 34 of the musician.

Returning to FIG. 1, in order to support guitar 12 in an upright stowed position where the body 14 and neck 18 are upwardly inclined slightly from the vertical, support stand 10 includes two elongated support legs 36, including left support leg 36′ and right support leg 36″, which extend downwardly from rear surface upper portion 22 and which terminate at respective feet 38′ and 38″. Guitar bottom edge 26 and feet 38 engage horizontal surface 33, such as a floor or table, to support guitar 12 thereon.

Support legs 36 are pivotally connected to guitar rear surface 21 at upper portion 22 in a manner to be discussed later in order to support movement of support legs 36 between an operable position shown in solid lines in FIG. 1 where feet 38 are spaced apart from each other as well as from bottom edge 26 to form a tripod-like configuration; and a stowed position shown in phantom in FIG. 1, where support legs 36 are positioned adjacent to each other along their longitudinal axes, as well as adjacent to guitar rear surface 21. In the present invention, increased support for the guitar in a generally erect position is provided by utilization of two support legs 36 in conjunction with the bottom edge 26 of the guitar. As guitar 12 is supported in the erect position at a slightly inclined angle from the vertical, the majority of the weight of the guitar is supported upon bottom edge 26. There may be, however, a tendency for the guitar to be somewhat unstable about its lengthwise axis 19 when in the erect position. The two support legs 36 which are spaced apart from the lower edge 26 and from each other to form an inverted V-like configuration, counteract any tendency which the guitar may have to rock about its lengthwise axis when in the erect position.

To pivotally connect support members 36 to guitar 12 for movement about a pivot axis designated by a line 39 (FIG. 2) which is parallel to rear surface 21, between a first position where feet 38 are adjacent to rear surface 21 and a second position where feet 38 are spaced apart from rear surface 21, support stand 10 includes mounting means, indicated at 46 in FIG. 2. Mounting means 46 which includes a generally planar mounting bracket 48 which is rigidly attached to outer surface 28 of mounting plate 27 in a face-to-face relationship therewith by fastening screws 50. Each fastening screw 50 includes a knurled outer knob (not shown) to permit convenient removal or attachment of mounting bracket 48 to mounting plate 27. Mounting means 46 also includes a support shaft 52 (FIG. 3) having a longitudinal axis which is generally perpendicular to the longitudinal axis of neck 18 and which is parallel to guitar rear surface 21. Shaft 52 is rigidly engaged at opposite ends thereof within outer sleeves 54 (FIG. 2) which in turn are rigidly connected to the outer surface of mounting bracket 48.

In order to provide support for a bass guitar which typically has a greater lengthwise body dimension, sleeve 54 vertically is offset from an imaginary centerline, designated by a line 55 (FIG. 2), which extends midway between and parallel to an upper edge 56 and a lower edge 57 of mounting bracket 27. The distance between the axis of sleeve 54 and centerline 55 is predetermined so that when mounting bracket 27 is attached to guitar surface 28 by inversion of mounting bracket 27 so that upper edge 56 is located below lower edge 57, and support legs 36 are mounted to extend downwardly from mounting bracket 27, feet 38 engage supporting surface 33 so as to support guitar 12 in a manner similar to that shown in FIG. 1.

Figure 3:
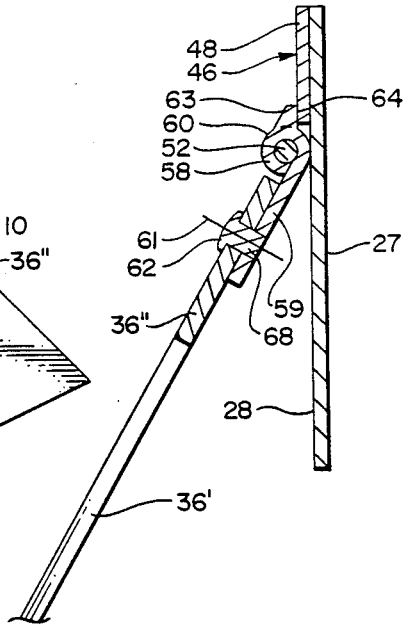
FIG. 3 is a side sectional view of the embodiment shown in FIGS. 1 and 2 taken along line 3—3 of FIG. 2, and showing the support legs in an operable position for supporting the guitar.

Support legs 36 are pivotally connected to shaft 52 by means of a swivel flange 58 having a planar portion 59 and an integral sleeve portion 60 located at the upper end thereof which is pivotally engaged about shaft 52 between end sleeves 54. The lower end of planar portion 59 is pivotally connected to legs 36 about a pivot axis designated by a line 61 by fasteners 62 (FIG. 3). Sleeve portion 60 of swivel flange 58 includes an integral upwardly extending lug 63 having an inner surface 64 which engages an elevated portion of the outer surface 28 to prevent pivotal rotation of planar portion 59 and legs 36 in an opening direction beyond a selected distance of feet 38 from guitar bottom edge 26 (FIG. 1).

To support legs 36 for pivotal movement between an "open" position where feet 38 are spaced apart from each other, and a "closed" position where legs 36 are adjacent to each other along their length, fasteners 62 each include an elongated shaft portion 68 (FIG. 3) which extends through support leg 36 and which is connected to planar portion 59 to permit pivotal movement of legs 36 about shaft 68. To prevent movement of legs 36 in an opening direction beyond a selected distance between feet 38, each of the upper ends of support legs 36 include opposing generally concave surfaces 66 (FIG. 2) which engage therebetween an upstanding stud 69 extending from the upper surface of bracket 58.

When legs 36 are in the stowed position and guitar 12 is held in a playing position as shown in FIG. 5, legs 36 are supported in a manner that legs 36 and feet 38 are adjacent to guitar rear surface portion 30 at a downward angle from an imaginary line 70 extending along a centerline of rear surface 21 in a manner parallel to neck axis 19. Left leg 36' is supported at this downward angle by the engagement of concave surface 66' of left leg 36' with stud 69. Left leg 36' in turn supports right leg 36' which pivots in a clockwise direction about pivot connector 62 to a location adjacent and aligned with the left leg 36', as shown in phantom in FIG. 2.

When legs 36 are supported at a downward angle relative to reference line 70 (FIG. 5), legs 36 are positioned across left portion 30 of guitar rear surface 21 as shown in FIG. 5. Thus, when guitar 12 is in the conventional playing position, the legs 36 are supported against the lower portion of the guitar rear surface 21 which is held away from the musician's body, as discussed previously, thereby allowing the right portion 31 to be held comfortably against the musician's body.

When the musician has finished playing the guitar, and desires to support it in an upright position on the floor or stage, the musician removes the guitar from his/her shoulders and pivots legs 36 to the open position about pivot connectors 62. Legs 36 are then pivoted to the operable support position, shown in FIG. 1, about pivot axis 39 (FIG. 2) to support the guitar on feet 38 and bottom edge 26. When the musician wishes to resume playing or to replace the guitar within the guitar case, the aforementioned sequence of events is reversed. Since feet 38 do not extend appreciably beyond bottom edge 26 when legs 36 are in the stowed position, stand 10 is easily stored in a guitar case. Furthermore, the aforementioned length of legs 36 allows guitar 12 to be slightly inclined from the vertical in the upright position. This provides additional stability to the upright support of the guitar 12.

It is known that electrical guitars typically have a number of "dead spots" which are believed to be caused by resonances in the wood which absorb the energy of string vibration at certain frequencies, resulting in varying levels of sound at different pitches. It is further known that when the mass of the instrument is increased, not only are these "dead spots" reduced, but the increased mass reduces the tendency of the vibrating strings to dissipate their energy. Since the neck of the guitar represents the least rigid structural component of the guitar, it is the most likely place for these "dead spots" to occur. In the present invention, support stand 10 is connected to the guitar neck 18 by means of fastening screws 29. By connecting the support stand 10 to the guitar neck 18, the stand is attached in a manner so as to connect its mass to the guitar neck and body, thereby increasing the effective mass of both the neck and the body, and consequently increasing the guitar sustain characteristics, i.e. the ability of the guitar to hold a played note for longer periods of time without diminishing.

Furthermore, the support stand 10 increases the effective mass of guitar body 14 which increases the "sustain" or the ability of the guitar to hold a played note for longer periods of time without diminishing. This "sustain" feature is particularly enhanced when the added mass of the support stand 10 is centered near the neck bracket 27.

Figure 6:
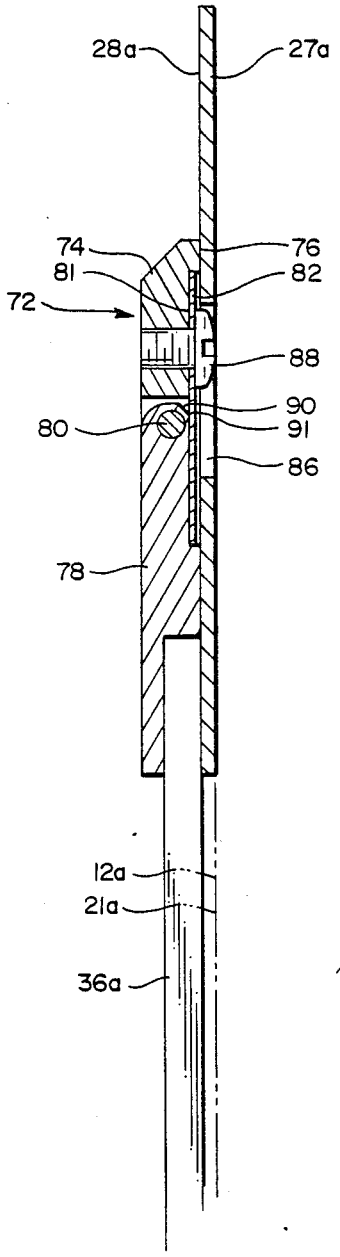
FIG. 6 is a side sectional view of another embodiment of the present invention which incorporates spring means to aid in retaining the support legs in operable and stowed positions.
Figure 7:
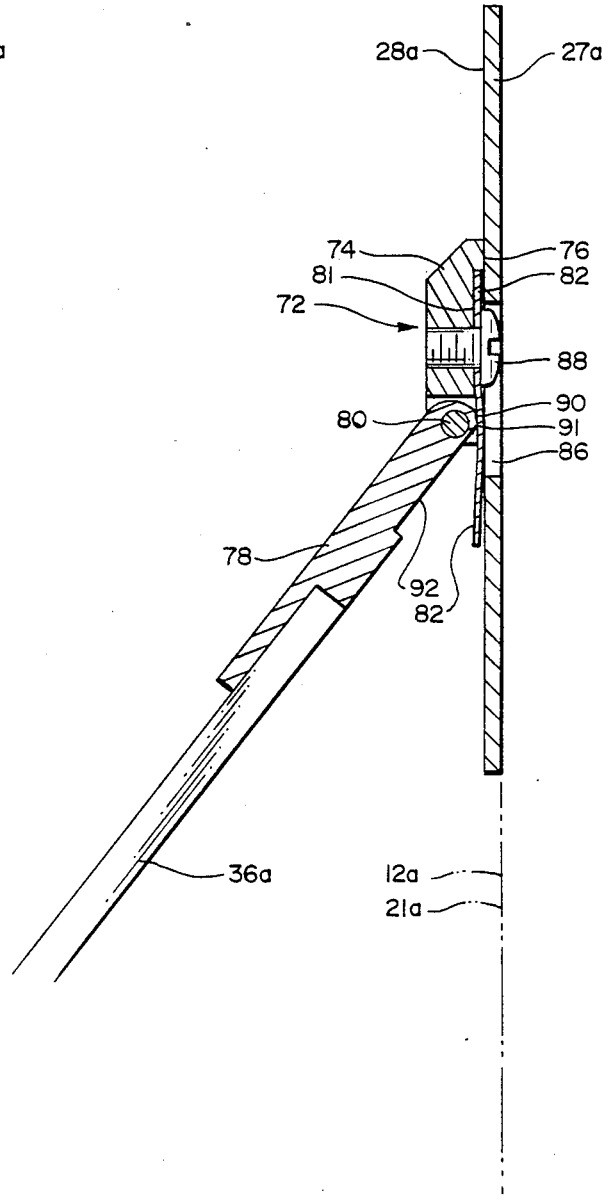
FIG. 7 is a side sectional view of the embodiment shown in FIG. 6 and showing the support legs in the operable support position.
Figure 8:
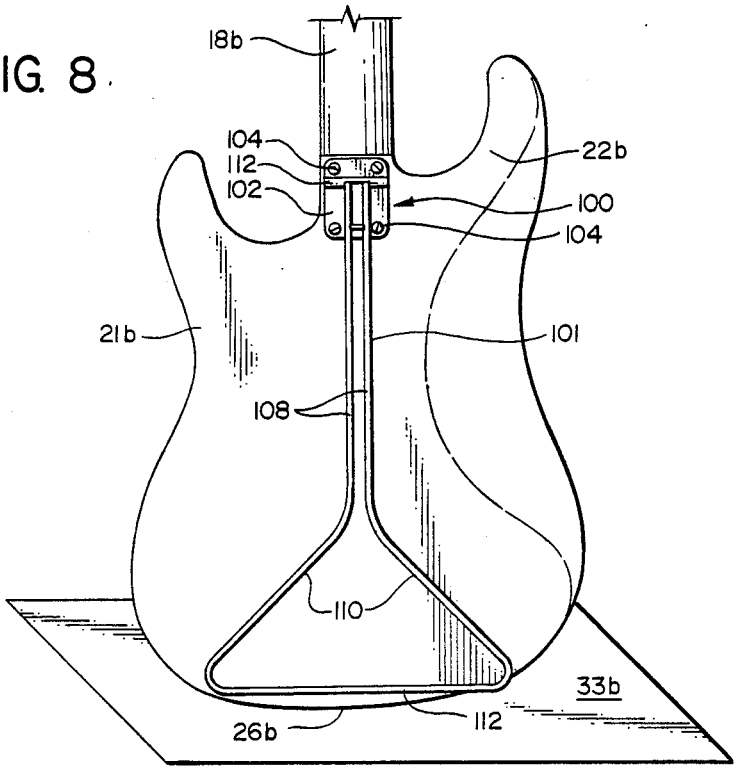
FIG. 8 is a plan view of another exemplary embodiment of the present invention including an integral one-piece support member formed from a resilient material and having a laterally extending support base for supporting the guitar in cooperation with the bottom edge of the guitar.

In another embodiment of the present invention shown in FIGS. 6 and 7, where the elements shown in the previous embodiment are designated by a like number with the suffix "a" attached, there is shown a mounting means indicated at 72 for pivotally connecting legs 36*a* to guitar mounting bracket 27*a*. Mounting means 72 includes a mounting plate 74 having an inner surface 76 which is mounted in a face-to-face relationship to outer surface 28*a* of mounting bracket 27*a* by fasteners (not shown). Mounting means 72 includes a leg attachment bracket 78 which is pivotally connected to mounting plate 74 by a pivot shaft 80 which extends through the lower end of mounting plate 74 and the upper end of leg attachment bracket 78. Leg attachment bracket 78 is connected to pivot shaft 80 in a manner that permits movement of bracket 78 and legs 36*a* therewith between the stowed position, shown in FIG. 6 where legs 36*a* are adjacent to the rear surface 21 of guitar 12*a*, and the operable position shown in FIG. 7 where the lower portion of legs 36*a* are spaced away from the guitar rear surface.

In order to aid in retaining legs 36*a* in both the stowed position and the operable position, the inner surface 76 of mounting plate 74 includes a recessed portion 81 which together with outer surface 28*a* encloses therebetween a planar shaped resilient member 82. Resilient member 82 extends across an opening 86 in mounting bracket 27*a* to a location below the lower portion of mounting plate 74 where attachment bracket 78 is connected to mounting plate 74. Resilient member 82 is secured to mounting plate 74 by a fastener 88 which attaches resilient member 82 to mounting plate 74 through opening 86. In order to bias legs 36*a* in the stowed position, the upper end of attachment bracket 78 includes an inner beveled edge 90 (FIG. 6) which joins at a corner 91 with an inner edge 92 (FIG. 7) of legs attaching bracket 78, which in turn extends parallel to the longitudinal axis of legs 36*a*.

Thus, when legs 36*a* are moved between the stowed and open positions, corner 91 engages a portion of resilient member 82 which overlies opening 86 causing resilient member 82 to flex inward into opening 86. When legs 36 are in the operable support position shown in FIG. 7, beveled edge 90 engages resilient member 82 causing resilient member 82 to flex inward slightly toward opening 86. The resulting opposing force from resilient member 86 against beveled edge 90 aids in retaining bracket 78 and legs 36*a* in the open operable position. However, when legs 36*a* are pivoted inward toward guitar rear surface 21*a*, corner 91 pivots inward toward opening 86 causing increased inward flexing of resilient member 82 until corner 91 reaches "overcenter" location, where corner 91 begins moving away from opening 86 and resilient member 82 resumes its unbended state. The resultant unbending of resilient member 82 biases bracket 78 and legs 36*a* toward the stowed position until bracket inner edge 92 is aligned with the surface of resilient member 82, and legs 36*a* are in the stowed position with resilient member 82 in its unbended state. Thus, any movement of bracket 78 toward the open position is resisted by resilient member 82.

In another embodiment of the present invention shown in FIGS. 8 through 13, where like elements described in the previous embodiment are designated by like numerals with a "b" suffix attached thereto, there is shown a mounting means indicated at 100 for attaching support stand 101 to guitar rear surface 21*b*. In the present embodiment, mounting means 100 includes planar bracket 102 which is connected to rear surface upper portion 22*b* of guitar 12*b* by fastening screws 104 which in turn engage neck 18*b* to connect neck 18*b* to body 12*b*. Support stand 101, which is pivotally connected to mounting bracket 102, is made of a resilient material and includes a pair of parallel downwardly depending wirelike members 108 which are integrally connected at their lower ends to outwardly and downwardly extending members 110, which in turn are integrally connected at their lower opposite ends to a laterally extending base member 112. Base member 112 is adapted to engage support surface 33*b* together with guitar bottom edge 26*b* to cooperatively support guitar 12*b* in the upright position in a manner similar to that described with reference to FIGS. 1 through 4.

Figure 9:
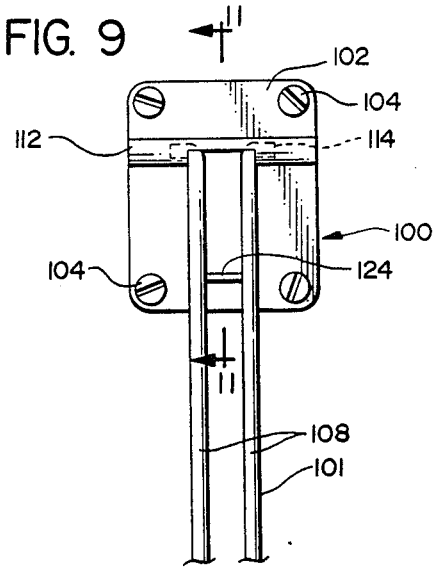
FIG. 9 is a plan view of an upper portion of the support member shown in FIG. 8 and showing the manner in which the support member is pivotally connected to the guitar.
Figure 10:
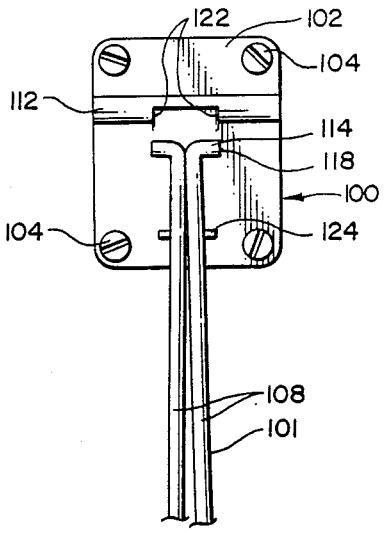
FIG. 10 is a plan view similar to the view of FIG. 9 and showing the support member in a configuration for being attached to a slotted mounting receptacle which in turn is attached to the rear surface of the guitar.

In order to pivotally connect support stand 101 to bracket 102, the upper portion surface of bracket 102 includes opposing axially aligned sleeves 112 (FIG. 9) which are rigidly mounted parallel to bottom edge 26*b* and which engage tip portions 114 of support stand 101. Tip portions 114 are integrally connected to the upper ends of support members 108, extend in opposing outward directions, and terminate at end surfaces 118. Support stand 101 can be easily attached and removed from sleeves 112 by pressing resilient members 108 together so that ends 118 define a distance, as shown in FIG. 10, which is less than the distance between inner openings 122 of sleeves 112, and then by removing or inserting tips 114 as desired. Once tips 114 are inserted within sleeves 112 and released, tips 114 resiliently return to their originally spaced apart position to secure support member 101 to bracket 102 as shown in FIG. 9.

Figure 11:
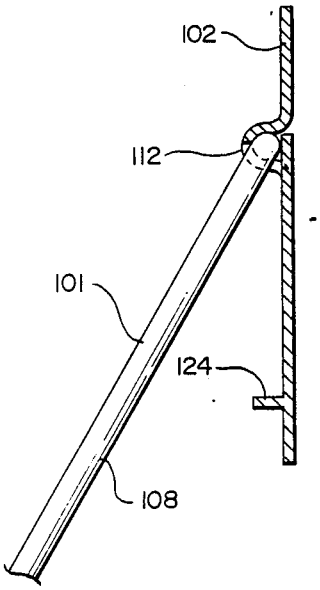
FIG. 11 is a side sectional view of the upper portion of the support member taken along line 11—11 of FIG. 9 and showing the support member in an operable position for supporting the guitar.
Figure 12:
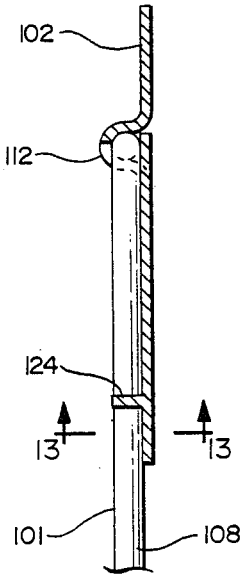
FIG. 12 is a side sectional view similar to the view of FIG. 11 and showing the support member in a stowed position where parallel downwardly extending legs of the support member are engaged around a flange upstanding from a mounting bracket.
Figure 13:
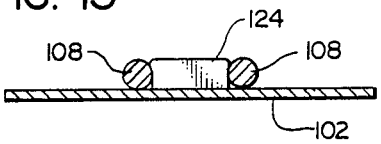
FIG. 13 is a sectional view of the upstanding flange taken along line 13—13 of FIG. 12.

Referring now to FIGS. 11 through 13, when support stand 101 is in the stowed position, members 108 are resiliently engaged about a flange 124 upstanding from the upper surface of bracket 102. Flange 124 has a lengthwise dimension slightly larger than the distance between support members 108 so that support stand 101 is secured in a stowed position, but nevertheless allowing resilient support legs 108 to be easily removed from about flange 124 by applying a moderate upward force.

What is claimed is:

1. A guitar having a lengthwise axis and a support stand which supports the guitar in a generally upright manner when the guitar is not in use and which remains connected to the guitar when the guitar is being played, the guitar comprising:

a. a guitar body including a front surface across which playing strings are located, a rear surface including a first upper portion and a second lower portion which are separated by said lengthwise axis, and a bottom surface adapted to support the guitar;

b. means for supporting the guitar on a player's body in a substantially horizontal playing position in a manner that the lower portion of the guitar body rear surface is spaced away from the player's body;

c. said support stand including (i) first and second elongate support legs for engaging a supporting surface, (ii) first means for connecting said first and second support legs to said guitar body to permit pivotal movement of said support legs between a first position where said support legs are spaced away from said guitar rear surface and a second position where said support legs are located adjacent to said guitar rear surface, and (iii) second means for connecting said first and second support legs to said guitar body in a manner to permit movement of said first asnd second support legs between a third position where said first and second support legs are spaced apart from each other at opposite sides of said lengthwise axis, and a fourth position where said first and second support legs are located at a same side of said lengthwise axis, so that when said first and second support legs (i) simultaneously occupy the first and third positions, said guitar is supportable in the upright manner in a support mode, and (ii) simultaneously occupy the second and fourth positions, said first and second support legs are located adjacent to said rear surface lower portion in a stowed mode so that said first and second support legs are spaced away from the player's body when the guitar is in the playing position.

2. The guitar as set forth in claim 1 wherein:

a. said first connecting means includes a first pivot connector for connecting said first and second support legs to said guitar body in a manner to permit said support legs to be pivoted about a first pivot axis between the first and second positions; and b. said second connecting means includes second and third poivot connectors for connecting said first and second support legs, respectively, to said guitar body in a manner to permit said support legs to be pivoted about second and third pivot axes, respectively, which are generally perpendicular to said first pivot axis, between said third and fourth positions.

3. The guitar as set forth in claim 2 wherein said second connecting means includes means (i) for engaging said first and second support legs to support said first and second support legs in the third position of the support mode, (ii) for engaging said first support leg in the stowed mode to support said first support leg in the fourth position below said second support leg, and (iii) for disengaging said second support leg to permit movement of said second support leg across said lengthwise axis from the third position of the support mode to the fourth position of the stowed mode.

4. The guitar as set forth in claim 2 wherein:

a. each of said support legs includes an upper portion and a lower portion, said first connecting means includes a flange member which is connected by said first pivot connector to asid guitar rear surface in a manner to permit movement of said flange member about said first pivot axis; and b. said second and third pivot connectors pivotally connect said first and second support legs, respectively, to said flange member at locations between said upper and said lower portions of said support legs in a manner to permit movement of said first and second support legs about said second and third pivot axes; and c. said engaging means includes an upstanding member which is connected to said flange between said first and second upper portions and which is engaged by said upper portions to support said first and second support legs in the third position of the support mode, and which is disengaged by said second upper portion to permit pivotal movement of said second support leg from the third position of the support mode to the fourth position of the stowed mode.

5. The guitar as set forth in claim 4 wherein:

a. said engaging member is an upstanding stud which is attached to said flange between respective inner surfaces of said first and second upper portions to support said first and second support legs in the second position of the support mode, and so that said inner surface of said first upper poriton engages said engaging member to support said first support leg in the fourth position of the stowed mode;

b. said second support leg is connected to said flange in a manner that when said first support leg is supported by the engaging member in the fourth position of the stowed mode and the guitar is in the playing position, the second leg is supported by the first support leg in the fourth position of the stowed mode.

6. The guitar as set forth in claim 5 wherein said inner surfaces of said first and second upper portions have respective concave configurations so as to engage said upstanding member to support said first and second legs in the third position of the support mode, and to permit said second upper portion to pivot about said second pivot connector when said second leg is moved to the fourth position of the stowed mode.

7. The guitar as set forth in claim 6 wherein:

a. said guitar includes a neck portion which is rigidly connected to said guitar body by a plurality of screw fasteners; and b. said first connecting means includes a mounting bracket which is fastened to said guitar adjacent to said guitar rear surface by said fasteners so as to increase the effective mass of the guitar and increase the guitar sustain characteristics.

8. The guitar as set forth in claim 6 wherein:

a. said first connecting means includes (i) a base plate which is connected to said guitar rear surface, and (ii) a resilient member which is connected to said base plate; and b. said flange member includes an end portion having a first engaging surface, said flange member being connected to said base plate in a manner that movement of said flange member away from said first position about said first pivot axis causes said engaging surface to contact said resilient member such that said resilient member urges said support legs toward said first position.

9. The guitar as set forth in claim 6 wherein the guitar is characterized by the absence of a recess in said rear surface for receiving said first and second support legs therein.

10. In a guitar having a lengthwise axis, and a guitar body including front surface across which playing strings are located, a rear surface including a first upper portion and a second lower portion which are separated by said lengthwise axis, the guitar being supported in a manner adjacent to a player's body in a playing position in which the lengthwise axis is substantially horizontal and so that the lower portion of the guitar body rear surface is spaced away from the player's body, an apparatus which remains attached to the guitar when it is being played and which is adapted to support the guitar on a supporting surface in a substantially upright manner when the guitar is not being played, the apparatus comprising:

a. first and second elongate support legs for engaging the supporting surface;

b. first means for connecting first and second support legs to said guitar body to permit pivotal movement of said support legs between a first position where said support legs are spaced away from said guitar rear surface and a second position where said support legs are located adjacent to said guitar rear surface; and c. second means for connecting said first and second support legs to said guitar body in a manner to permit movement of said first and second support legs between a third position where said first and second support legs are spaced apart from each other at opposite sides of said lengthwise axis, and a fourth position where said first and second support legs are located at a same side of said lengthwise axis, so that when said first and second support legs (i) simultaneously occupy the first and third positions, said guitar is supportable in the upright manner in a support mode, and (ii) simultaneously occupy the second and fourth positions, said first and second support legs are located adjacent to said rear surface lower portion in a stowed mode so that said support legs are spaced away from the player's body when the guitar is in the playing position.

11. The guitar as set forth in claim 10 wherein:

a. said first connecting means includes a first pivot connector for connecting said first and second support legs to said guitar body in a manner to permit said support legs to be pivoted about a first pivot axis between the first and second positions; and b. said second connecting means includes second and third pivot connectors for connecting said first and second support legs, respectively, to said guitar body in a manner to permit said support legs to be pivoted about second and third pivot axes, respectively, which are generally perpendicular to said first pivot axis, between said third and fourth positions.

12. The guitar as set forth in claim 11 wherein said second connecting means includes means (i) for engaging said first and second support legs to support said first and second support legs in the third position of the support mode, (ii) for engaging said first support leg in the stowed mode to support said first support leg in the fourth position below said second support leg, and (iii) for disengaging said second support leg to permit movement of said second support leg across said lengthwise axis from third position of the support mode to the fourth position of the stowed mode.

13. The guitar as set forth in claim 12 wherein:

a. each of said support legs includes an upper portion and a lower portion, said first connecting means includes a flange member which is connected by said first pivot connector to said guitar rear surface in a manner to permit movement of said flange member about said first pivot axis; and b. said second and third pivot connectors pivotally connect said first and second support legs, respectively, to said flange member at locations between said upper and said lower portions of said support legs in a manner to permit movement of said first and second support legs about said second and third pivot axes; and c. said engaging means includes an upstanding member which is connected to said flange between said first and second upper portions and which is engaged by said upper portions to support said first and second support legs in the third position of the support mode, and which is disengaged by said second upper portion to permit pivotal movement of said second support leg from the third position of the support mode to the fourth position of the stowed mode.

14. The guitar as set forth in claim 13 wherein:

a. said engaging member is an upstanding stud which is attached to said flange between respective inner surfaces of said first and second upper portions to support said first and second support legs in the second position of the support mode, and so that said inner surface of said first upper portion engages said engaging member to support said first support leg in the fourth position of the stowed mode;

b. said second support leg is connected to said flange in a manner that when said first support leg is supported by the engaging member in the fourth position of the stowed mode and the guitar is in the playing position, the second leg is supported by the first support leg in the fourth position of the stowed mode.

15. The guitar as set forth in claim 14 wherein said inner surfaces of said first and second upper portions have respective concave configurations so as to engage said upstanding member to support said first and second legs in the third position of the support mode, and to permit said second upper portion to pivot about said second pivot connector when said second leg is moved to the fourth position of the stowed mode.

* * * * *